United States Patent [19]

Naudet

[11] Patent Number: 4,604,030

[45] Date of Patent: Aug. 5, 1986

[54] COMPRESSOR WITH VARIABLE INCIDENCE STATOR VANES

[75] Inventor: Jacky Naudet, Bondoufle, France

[73] Assignee: Societe Nationale d'Etude et de Construction de Moteurs d'Aviation S.N.E.C.M.A., Paris, France

[21] Appl. No.: 675,214

[22] Filed: Nov. 27, 1984

[30] Foreign Application Priority Data

Dec. 7, 1983 [FR] France ..... 83 19538

[51] Int. Cl.[4] ..... F01D 11/02; F04D 29/56

[52] U.S. Cl. ..... 415/126; 415/149 R; 415/160; 415/171

[58] Field of Search ..... 415/126, 127, 128, 129, 415/130, 131, 132, 133, 149 R, 159, 160, 171, 172 A, 161-165, 199.5, 174

[56] References Cited

U.S. PATENT DOCUMENTS

| | | | |
|---|---|---|---|
| 3,079,128 | 2/1963 | Burge | 415/191 |
| 3,325,087 | 6/1967 | Davis | 415/133 X |
| 3,990,810 | 11/1976 | Amos et al. | 415/161 |
| 3,999,883 | 12/1976 | Nordenson | 415/171 X |

FOREIGN PATENT DOCUMENTS

| | | |
|---|---|---|
| 0093631 | 4/1983 | European Pat. Off. . |
| 1114241 | 4/1956 | France . |
| 1214261 | 4/1960 | France . |
| 2021741 | 7/1970 | France . |
| 2386071 | 3/1978 | France . |
| 315424 | 9/1956 | Switzerland . |
| 749577 | 5/1956 | United Kingdom . |
| 2016091 | 9/1978 | United Kingdom . |
| 2019501 | 10/1979 | United Kingdom . |
| 2065785 | 7/1981 | United Kingdom . |

*Primary Examiner*—Robert E. Garrett
*Assistant Examiner*—Joseph M. Pitko
*Attorney, Agent, or Firm*—Oblon, Fisher, Spivak, McClelland & Maier

[57] ABSTRACT

The invention relates to a turbo-machine incorporating a compressor with stator vanes of which the angle of incidence is adjustable. In order to enable adjustment in the position of the internal ring of a stator of the compressor, each of the sectors of the ring is provided with adjustment locations constituted by the bushes of pivot bearings for the roots of the vanes which roots comprise an external screw thread cooperating with a complementary internal screw thread of their seating and these come into abutment against a shoulder of the pivot of each vane so that the radial position of each of the sectors can be adjusted by rotation of the bushes in their respective seating.

8 Claims, 4 Drawing Figures

COMPRESSOR WITH VARIABLE INCIDENCE STATOR VANES

BACKGROUND OF THE INVENTION

1. Field of the Invention

The invention relates to stators of compressors with vanes of variable angle.

2. Summary of the Prior Art

Stators of this type are constituted by vanes mounted with the facility of rotation about their longitudinal axis within the casing of the compressor, their angle of incidence with respect to the axis of the engine being controlled by a mechanism external to the casing, comprising, for example, a synchronizing ring of which the motion is transmitted to the pivots at the tips of the blades through the intermediary of linkages.

At their inner ends, nearer to the axis of the engine, these vanes are generally interconnected by an inner ring divided into a plurality of sectors of which the upper face defines the interior wall of the flow path and which supports sealing means such as a fluid-tight gasket cooperating with the lips of a labyrinth seal rigid with the rotor in order to restrict the internal flow losses between the downstream and upstream of the stator stage.

The invention relates in particular to the connection point of the roots of the vanes to the internal vane ring. This connection is provided by means of a root pivot within a bearing bush located in a radial bore of the ring; in order to enable free expansion of the ring during operation, the latter has a certain freedom for sliding along the pivots of the vane roots.

The degree of clearance between the lips and the abradable gasket is critical for the efficiency and the performance of the engine. On the assumption of achieved tolerances at 100%, the radial location and the rigidity of the ring are ensured by the radial disposition of the vanes. The clearances are thus determined with precision. In practice, the vanes may acquire, during assembly, an inclination in a plane transverse to the axis of the engine, which is more or less pronounced. Furthermore, the clearance between the pivot and pin is not zero; this leads to a degree of scattering in the radial position of each sector which is not compensated when these sectors are interconnected by fluid-tight and wear seal supporting rails because the rigidity of the assembly is inadequate. Thus, the ring may deviate from a true circle and, its centering with respect to the rotor may be defective. Furthermore, during operation the end positions of the sectors of the rings are difficult to estimate; in the absence of any abutment especially between the platforms of the vanes and the sectors of the ring, the inner portions of the vanes may come into contact with the wall of the ring with, as a consequence, possible damage to the vanes when they are controlled to turn about their axes by the control system.

A first improvement consisted in the reduction of the number of sectors constituting the ring and the rail in order to limit the effects resulting from splitting into parts and to introduce at the tip of each blade below the control lever a packing piece limiting the radial position of the vane, the thickness of this packing piece being determined as a function of the residual clearance at the point of attachment. Finally, by locating a distance piece serving as a stop between the pivot of the root and the rail, it is possible to limit the variations in the radial position of the sectors. Nevertheless, apart from difficulties in realising by this method satisfactory centring of the ring with respect to the rotor its practical use complicates maintenance operations because of the risk of inversion of the packing-piece or distance piece during reassembly.

There is known, furthermore, from U.S. Pat. No. 3,079,128 an arrangement where the root pivot is terminated in a screw thread, in such a manner that the sector of the ring can be radially locked between a nut screwed onto the pivot and the platform of the vane. Such a construction gives rise to the disadvantage that it is not capable of adjustment in the position of the sector of the ring thereby necessitating the repositioning in place, as a result of wear of the fluid-tight and wear seal; furthermore, the ring has no freedom of sliding motion enabling the accommodation of differential expansions during operation.

GB-A No. 749 577 describes an internal ring assembly of a stator with the possibility of adjustment. The vanes are secured to the ring by means of a pin mounted eccentrically within an axial bore of the roots of the vane through the intermediary of a sleeve having inner and outer eccentric axes. It is possible by these means to effect an adjustment in the position of the ring with respect to the vanes and to the rotor. Unfortunately, such a system cannot be applied to a stator of which the vanes have adjustable incidence.

One object of the present invention is therefore to limit variations in the radial position of the ring in a compressor stator having variable angle vanes.

Another object of the invention is substantially to eliminate risk of contact between the inner parts of the vanes and the internal ring.

A further object is to facilitate the control of the position of the ring in such a stator assembly.

SUMMARY OF THE INVENTION

According to the present invention there is provided a turbo machine comprising a rotor having rotor blades in at least one annular array, a stator having vanes of variable incidence in at least one annular array, the vanes being in operative relationship with at least one said array of rotor blades, each vane having means defining a shoulder at its radially inner end, a casing of the rotor and stator having annulus means, bearing means carried by the annulus means and receiving the stator vanes for variation of the angle of incidence thereof, each stator vane including pivot means engaged in the bearing means, the annulus means also including a plurality of sectors, sealing means intended to limit leakage losses between the stator and the rotor and mounted to each sector, and adjustment means for the stator vanes distributed between the sectors, the bearing means comprising means defining a bush at the location of each adjustment means, each bush including externally a screw thread, internally screw-threaded seating means receiving the bush in screw-threaded relationship, relative angular motion of each bush relative to the corresponding seating serving in cooperation with the shoulder to adjust the radial location of the corresponding sector, and means for locking the bush in the adjusted radial location on completion of said adjustment.

Preferably the locking means comprises a radially and circumferentially extending flange rigid with the outer face of a fluid-tight and wear seal carrying rail, which comes into abutment against one of the faces of the prismatic base of the bush.

DESCRIPTION OF THE PREFERRED EMBODIMENTS

Figure 1:
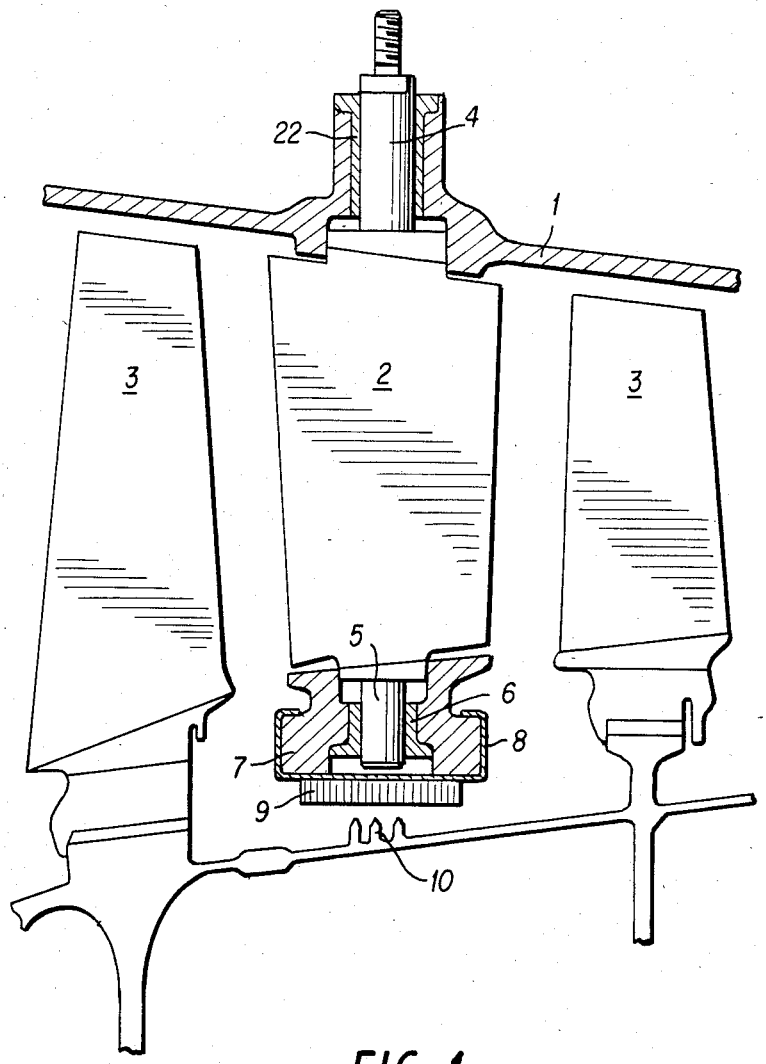
FIG. 1 is an axial section of one part of a compressor illustrating a pivotal connection of the root ring without adjustment means.

Referring to FIG. 1, a part of the compressor of a gas turbine is illustrated in axial section. Within the casing 1 one stator stage separates two stages of rotor blades 3 mounted on a drum rotor. The stator is formed by an array of vanes 2 extending radially from the casing 1 on which they are mounted for rotation about their longitudinal axes through the intermediary of a tip pivot 4 which can be turned within a bearing of the casing 1, through the intermediary of a bush 22. The pivot 4 is connected to a mechanism for adjustment of the angle of incidence (not shown). At the other end, closer to the axis, the vanes are provided with a root pivot 5 movable in a bush 6 secured in a radial bore of one sector of the inner ring 7. The inner ring defines by its outer face the internal wall of the gas flow path of the compressor, the sectors forming it being interconnected by a rail 8 likewise divided into segments 8*a*, 8*b*, . . . , separated at edges 8*c* (see FIG. 4) of which the number is less than that of the sectors. Edge portions of the rail 8 are bent to a hook-like section 82 (see FIGS. 2 and 3) and engage with two lateral flanges of the ring.

Rail 8 serves as a support for a material forming a fluid-tight and wear seal 9 which cooperates in known manner, with lips 10 of a labyrinth seal rigid with the rotor, in order to reduce leakages resulting from the pressure difference existing across the stator stage.

As hereinbefore mentioned, the radial position of the sector ring 7 cannot be determined with precision because of manufacturing and assembly tolerances. During operation, the ring sectors can slide along pivots modifying the clearance between the fluid-tight and wear seal and the labyrinth seal on the one hand, the clearance between the internal edges of the vanes and the wall of the flow path on the other hand. When the latter clearance becomes zero, the operation of the control means for adjusting the incidence of the vanes is liable to give rise to deterioration of the latter.

Finally the poor location of the ring, which serves to define the flow path, is the cause of disturbance in the aerodynamic operation of the compressor.

In accordance with the invention these defects can be overcome by forming a control point at each end of the sectors.

Figure 2:
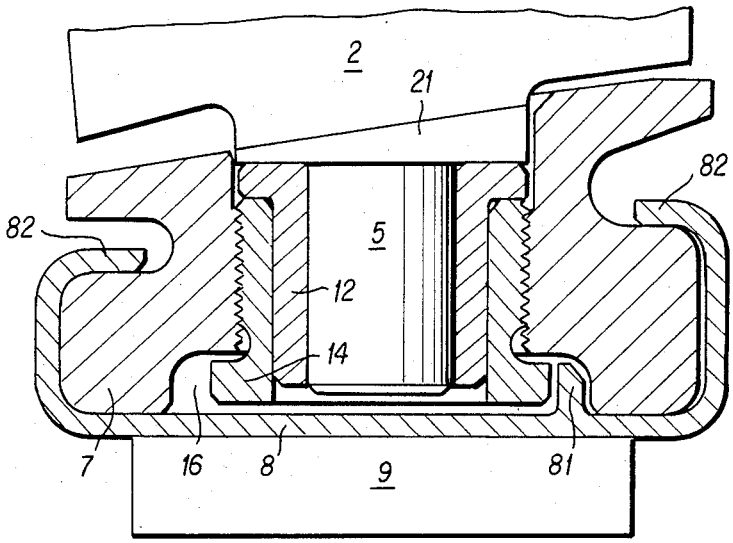
FIG. 2 is a view to an enlarged scale of the connection pivot of the root-ring having adjustment means in accordance with the invention.

Referring to FIG. 2 an embodiment in accordance with the invention is illustrated, the parts remaining unchanged with respect to FIG. 1 retaining the same reference numeral.

The pivot 5 of the vane 2 turns in a bush 12 constituted by a self-lubricating material such as graphite. This bush is itself supported by a second bush 14 provided with an external screw thread cooperating with a complementary screw thread within its seating in the ring sector 7. Flats 15 are formed on the enlarged base of the bush 14 which thus has a transverse section in the form of a polygon for example a hexagon (FIG. 4), the base extending into a peripheral groove of the internal face of the ring 7. This groove provides around the base of the bush a space enabling on the one hand, the use of a tool and on the other hand a sufficient relative displacement of the bush within the sector. In particular the bush 12 must be able to come into abutment against an inner shoulder of the platform 21. The platform is engaged in a recess extending beyond the screw-threaded part of the housing of the bush 14.

In order to avoid during operation any inadvertent rotation of the bush 14 a tab lock acting on the inner ring ensures adequate locking. With this in mind, the rail 8 includes a radial, circumferential, flange 81 on its upper face which locates in the groove 16 of the ring and against which one of the flats of the base of the bush abuts.

Figure 3:
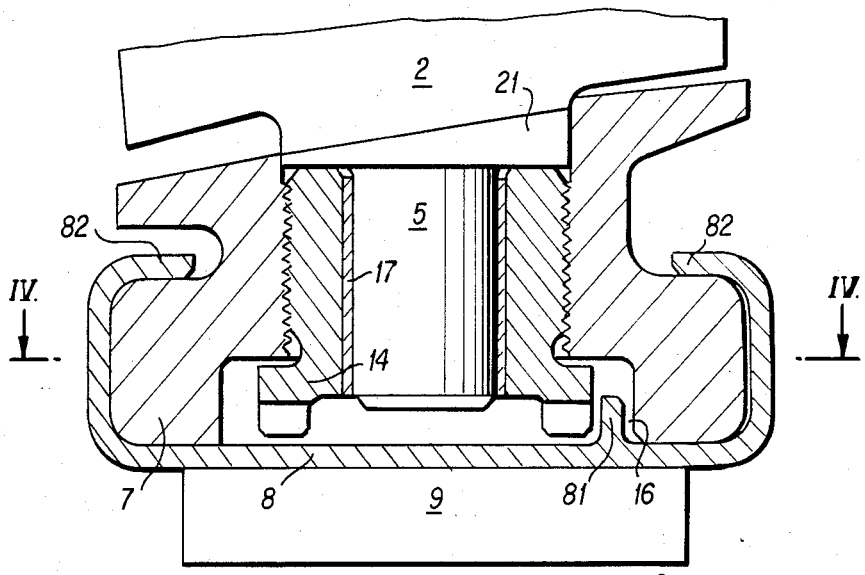
FIG. 3 is a view similar to FIG. 2 but illustrating a slightly modified embodiment.
Figure 4:
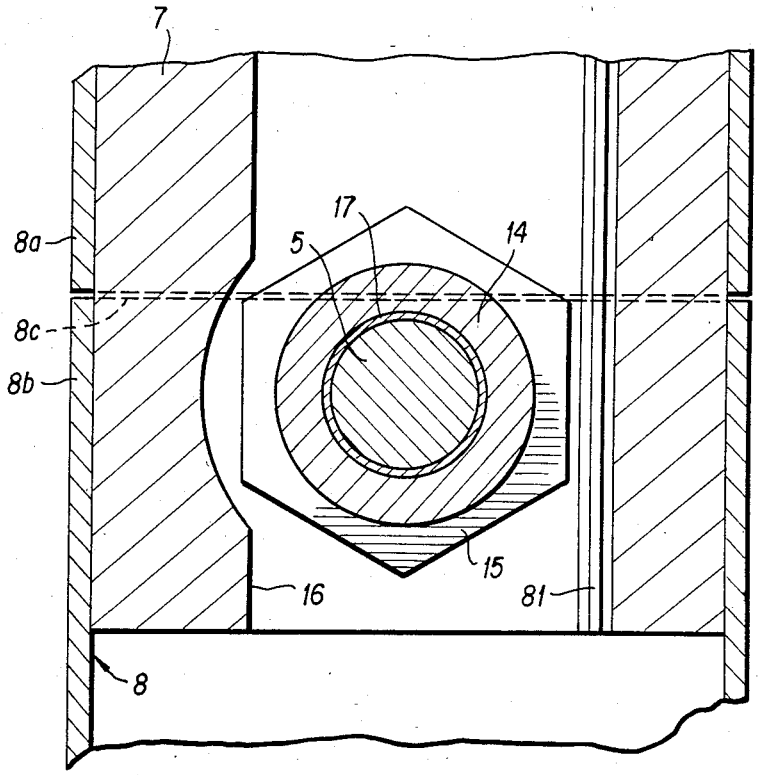
FIG. 4 is a partly sectional view along the line III—III of FIG. 3.

In FIG. 3, instead of employing a graphite bush 12 between the pivot 5 and the bush 14, the pivot 5 is coated with an antifriction material 17 such for example as TEFLON.

The assembly and the adjustment in position of the inner ring is effected in the following manner:

After having located the vanes within the casing, with the bushes 22 disassembled, the sectors at the ends of each of which an adjustment point is provided are put into place by introducing the pivots 5 into their respective bearing. The bushes 22 are then reassembled on the tip pivots 4. In order to assist assembly, an initial loose location of the bushes 14 is arranged so that approximate positioning of the ring is effected. The location point by point is effected by screwing/unscrewing of the bushes 14, the latter being in contact with the corresponding platform 21. This operation is effected in correlation with control of the desired positioning. Care is taken to cease rotation of the bushes 14 at a flat parallel to the edge of the groove 16 and providing for engagement with the flange 81.

It will be noted that if the base of the bush 14 is divided into six flats and that the pitch of the screw thread is 0.5 mm., the precision of the adjustment by one-sixth of a turn of the pin is 0.08 mm. The ring is thus built up step by step and the sectors made rigid with respect to one another by locating segments of the wear and fluid-tight seal carrying rail 8.

It will be apparent that as a result of the construction in accordance with the preferred embodiment it is possible to control the geometry of the ring and to ensure continuity in the inner wall of the flow path whilst at the same time eliminating differential projections between sectors. Furthermore, it is possible to employ manufacturing tolerances which would normally be noncompatible with the clearances required. Finally, it is possible substantially to guarantee clearances between rotors and stators within reduced limits.

What is claimed is:

1. A turbo machine comprising:

a casing having annulus means, a rotor in said casing and having rotor blades in at least one annular array, a stator in said casing and having vanes of variable incidence in at least one annular array, the vanes being in operative relationship with at least one said array of rotor blades, each said vane having means defining a shoulder at its radially inner end, bearing means carried by the annulus means and receiving the stator vanes for variation of the angle of incidence thereof, each stator vane including pivot means engaged in the bearing means, the annulus means also including a plurality of sectors, sealing means intended to limit leakage losses between the stator and the rotor and being mounted to each sector, and adjustment means for the stator vanes distributed between the sectors, wherein the bearing means comprise means defining a bush at the location of each adjustment means, each said bush including an external screw thread, and internally screw-threaded seating means receiving the bush in screw-threaded relationship, wherein relative angular motion of each bush relative to the corresponding seating serves in cooperation with the shoulder to adjust the radial location of the corresponding sector, and means for locking the bush in the adjusted radial location on completion of said adjustment.

2. A turbo-machine according to claim 1, wherein the seating means are provided at each peripheral end of each sector.

3. A turbo-machine according to claim 2 wherein each pivot means is coated with an anti-friction material.

4. A turbo-machine according to claim 2, comprising a graphite sleeve interposed between each pivot means and the corresponding bush.

5. A turbo-machine according to claim 1 wherein each pivot means is coated with an anti-friction material.

6. A turbo-machine according to claim 1 comprising a graphite sleeve interposed between each pivot means and bush.

7. A turbo-machine according to claim 1, wherein the locking means comprises a base of each bush having a polygonal cross section externally, and wherein a lock tab cooperating with the base of each bush and with the corresponding sector of the annulus means.

8. A turbo-machine according to claim 7, wherein the annulus means carries a rail supporting the sealing means, and the rotor carries lips which form with said sealing means, a labyrinth seal, the lock tab taking the form of a radially-extending flange of the radially outwardly by directed face of the said rail.

* * * * *